US006932312B1

(12) United States Patent
Chen

(10) Patent No.: US 6,932,312 B1
(45) Date of Patent: Aug. 23, 2005

(54) SUSPENSION DEVICE FOR A TOOL HANDLE

(76) Inventor: Wen-Chun Chen, 58-1, Erhkang Village, Fuhsing Hsiang, Changhua Hsien (TW)

( * ) Notice: Subject to any disclaimer, the term of this patent is extended or adjusted under 35 U.S.C. 154(b) by 0 days.

(21) Appl. No.: 10/779,792

(22) Filed: Feb. 18, 2004

(51) Int. Cl.[7] ..... A47G 1/10
(52) U.S. Cl. ..... 248/316.1; 248/74.2; 248/113; 211/60.1; 211/89.01
(58) Field of Search ..... 248/110, 113, 316.1, 248/316.2, 316.3, 316.7, 74.2, 230.1; 211/60.1, 211/66, 68, 89.01

(56) References Cited

U.S. PATENT DOCUMENTS 572,770 A * 12/1896 Putnam ..... 211/19
1,174,185 A * 3/1916 Scott ..... 211/68
1,503,120 A * 7/1924 Drost ..... 211/68
3,512,227 A * 5/1970 Krawagna ..... 248/113
3,812,976 A * 5/1974 Rempel ..... 211/70.6
4,614,321 A * 9/1986 Andre ..... 248/74.2

* cited by examiner

*Primary Examiner*—Korie Chan
(74) *Attorney, Agent, or Firm*—Fei-Fei Chao; Bingham McCutchen LLP

(57) ABSTRACT

A suspension device for a tool handle has a body (10) with a U-shaped recess (13), and an elastic bracket (20) mounted on the body (10) at two ends in front of the U-shaped recess (13). When the tool handle presses the elastic bracket (20) and the tool handle into the U-shaped recess (13), the tool handle is clamped by the deformed elastic bracket (20) within the U-shaped recess (13). Thereby, the tool handle is directly mounted in the suspension device by simple pressing. Additionally, the body (10) can be detachably mounted on a track assembly to adjust the position of the suspension device and the tool handle.

8 Claims, 5 Drawing Sheets

SUSPENSION DEVICE FOR A TOOL HANDLE

BACKGROUND OF THE INVENTION

1. Field of the Invention

The invention relates to a suspension device for a tool handle, and particularly to a suspension device that directly clamps the handle to suspend the tool.

2. Description of Related Art

Multiple tools with long handles, such as brooms, mops, rakes, shovels and the like, are usually stored by hanging them handle down or by a ring attached to a distal end of the handle. The ring is looped on a hook attached high on a wall because the handles are long. However, looping the ring on a hook high on a wall is difficult and inconvenient. Additionally, the hooks are attached securely to the wall so that distances between tools cannot be adjusted.

The present invention has arisen to provide a suspension device for a tool handle to overcome the drawbacks of conventional fixtures to store tools with handles.

SUMMARY OF THE INVENTION

A main objective of the present invention is to provide a suspension device for a tool handle, which directly clamps the tool handle.

Further benefits and advantages of the present invention will become apparent after a careful reading of the detailed description in accordance with the drawings.

DETAILED DESCRIPTION OF THE PREFERRED EMBODIMENT

A suspension device for a tool handle in accordance with the present invention comprises a base with a handle recess and an elastic bracket mounted on the base in front of the handle recess.

Figure 1:
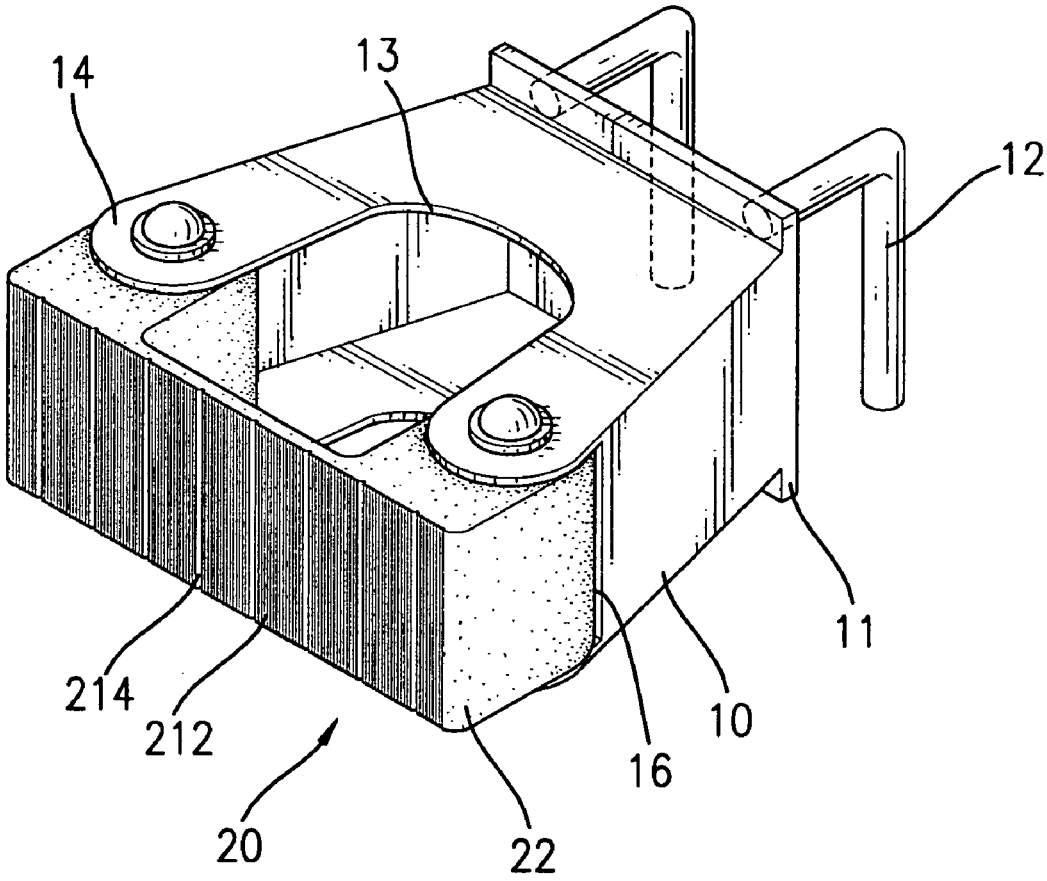
FIG. 1 is a perspective view of a suspension device for a tool handle in accordance with the present invention.
Figure 2:
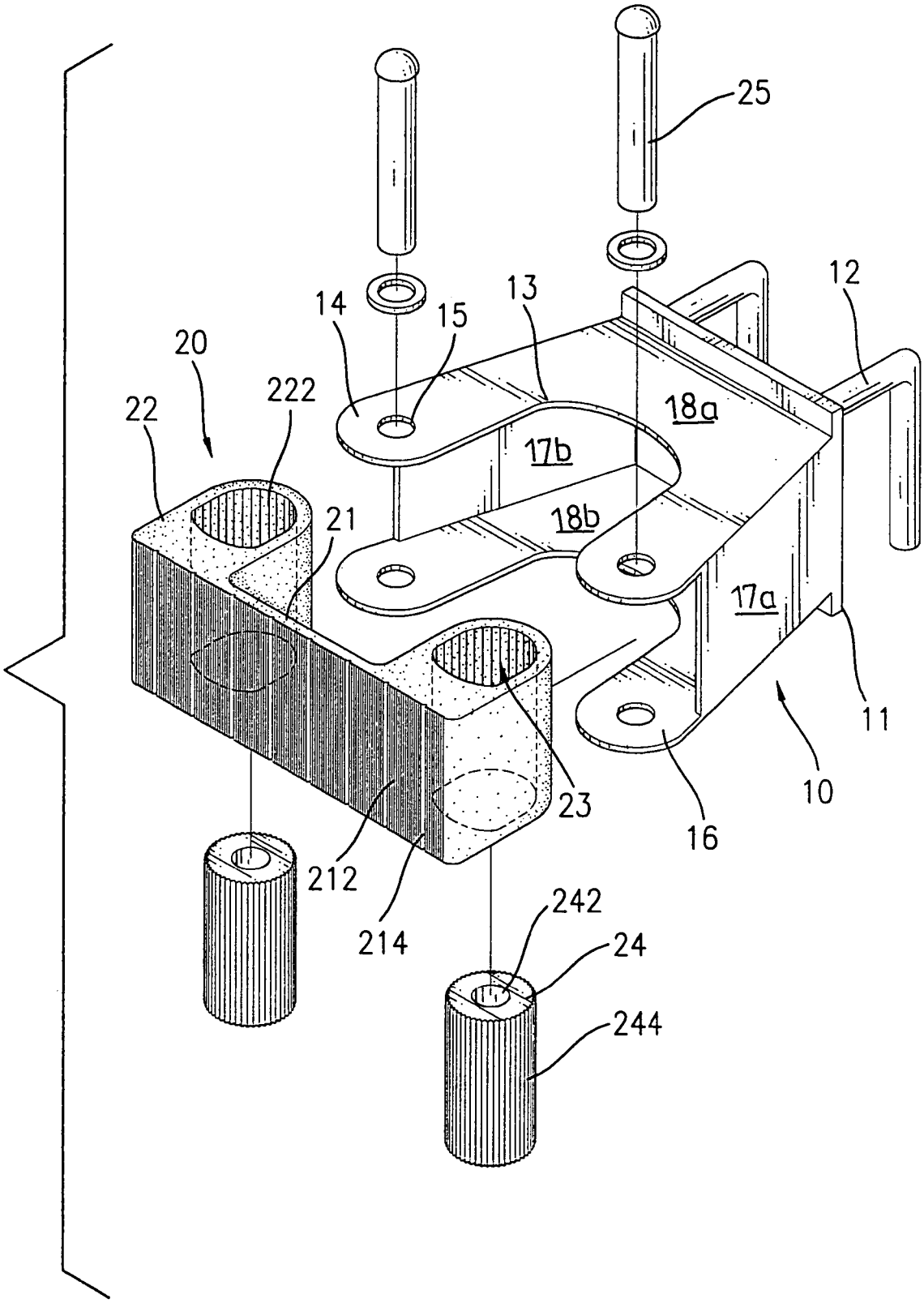
FIG. 2 is an exploded perspective view of the suspension device for a tool handle in FIG. 1.

With reference to FIGS. 1 and 2, a preferred embodiment of the suspension device in accordance with the present invention comprises a hollow body (10), an elastic bracket (20), two rollers (24) and two pivot pins (25).

The hollow body (10) has a back plate (11), two braces **(17*a* and 17*b*), a top bracket (18*a*), a bottom bracket (18*b*), two roller spaces (16) and two optional hooks (12)**.

The back plate (11) is rectangular and has a top edge (not numbered), a bottom edge (not numbered), two ends (not numbered), a front surface (not numbered), and a rear surface (not numbered). The front surface has a top lip (not numbered) and a bottom lip (not numbered). The top lip is formed along the top edge, and the bottom lip is formed along the bottom edge.

The two braces extend from the front surface of the back plate (11) respectively at the two ends, and each brace has a top edge (not numbered) and a bottom edge (not numbered).

The top bracket has a front end (not numbered), two side edges (not numbered), a U-shaped recess (13), two ears (14) and two pivot pin holes (15), extends from the back plate (11) near the top edge and forms the top lip on the front surface of the back plate (11). The side edges of the top bracket are connected respectively to the top edges of the two braces. The U-shaped recess (13) is formed in the front end and forms the ears (14) respectively on opposite sides. The pivot pin holes (15) are formed respectively in the ears (14) near the front end.

The bottom bracket has a front end (not numbered), two side edges (not numbered), a U-shaped recess (13), two ears (14) and two pivot pin holes (15), extends from the back plate (11) near the bottom edge and forms the bottom lip on the front surface of the back plate (11). The side edges are connected to the bottom edges of the two braces. The front end, two side edges, U-shaped recess, two ears and two pivot pin holes of the bottom bracket correspond respectively to and align respectively with the front end, the two side edges, the U-shaped recess, the two ears (14) and the two pivot pin holes (15) in the top bracket.

The roller spaces (16) are defined between two opposite ears (14) in the top and bottom bracket.

The two optional hooks (12) are attached to and extend out from the rear surface of the back plate (11) and attach the suspension device to a wall (not shown) or a panel (not shown).

The elastic bracket (20) is made of resilient material and has a straight sheet (21) and two roller sleeves (22). The resilient material may be rubber, pliable synthetic materials or the like.

The straight sheet (21) has two ends (not numbered), an outer face (not numbered), multiple optional ridges (212) and multiple optional widened V-shaped grooves (214). The optional ridges (212) are defined transversely on the entire outer face and grip the handle of a tool. Optional multiple widened V-shaped grooves (214) are defined transversely at intervals on the outer face of the straight sheet (21).

The two roller sleeves (22) are formed respectively at the two ends of the straight sheet (21) clamped between two corresponding ears respectively in the roller spaces (16) and respectively have internal roller cavities (23) defined longitudinally in the roller sleeve (23). The roller cavity (23) has an inner surface (not numbered), multiple teeth (222) and an inner diameter (not numbered). The teeth (222) are formed longitudinally on the inner surface of the roller cavity (23).

The two rollers (24) are mounted respectively inside the two roller sleeves (22) of the elastic bracket (20). Each roller (24) has an axial through hole (242), an outer diameter (not numbered), an outer surface (not numbered) and multiple optional teeth (244) defined longitudinally on the outer surface. To attach the elastic bracket (20) to the hollow body (10), the axial through holes (242) in the rollers (24) mounted respectively in the roller cavities (23) are aligned with the corresponding pivot pin holes (15) in the top and bottom brackets, and the pivot pins (25) are inserted respectively into the pivot pin holes (15) and the axial through holes (242).

Figure 4:
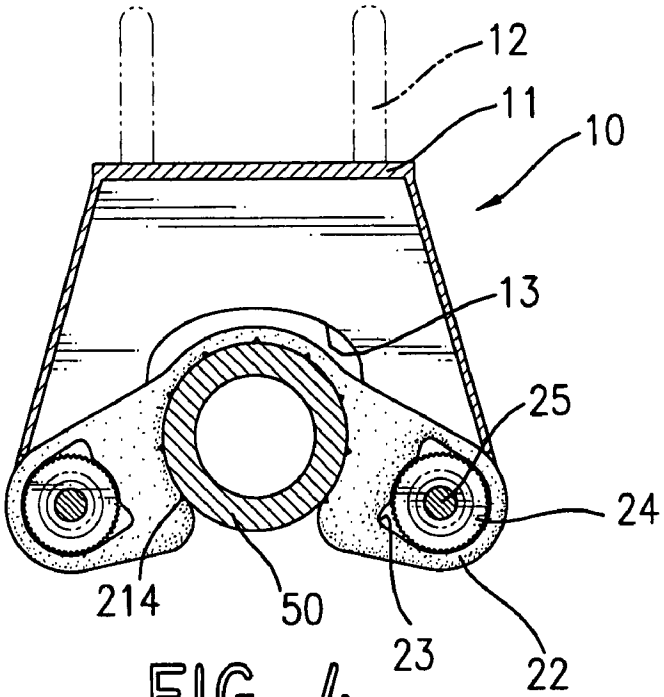
FIG. 4 is an operational cross-sectional top plane view of the suspension device for a tool handle in FIG. 1 with a tool handle pressed into a handle recess in a base and clamped by an outer face on an elastic bracket within the handle recess.
Figure 3:
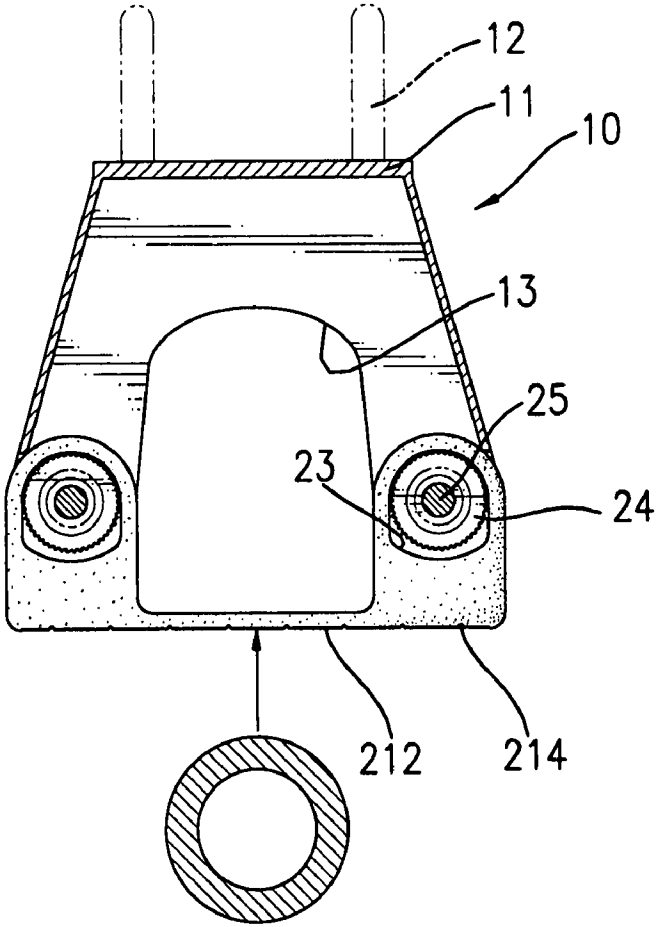
FIG. 3 is a cross-sectional top plane view of the suspension device for a tool handle in FIG. 1.

With reference to FIGS. 3 and 4, a tool handle (50) is attached to the suspension device by pressing the handle (50) against the straight sheet (21) and pressing the tool handle (50) and then into the U-shaped recess (13). The roller (24) allows the roller sleeve (22) to pivot when the straight sheet (21) with the tool handle (50) is pressed into the U-shaped recess (13). Wherein, when the straight sheet (21) is compressed, the tool handle (50) overcomes a maximum deformation force, i.e. a restitution force from the deformed elastic bracket, just right at a shortest straight line between the two rollers (24), then the tool handle (50) enters the U-shaped recess (13). Hereafter, the restitution force cause from the deformed elastic bracket (20) within the stick recess (13) can not overcome the maximum deformation force at the straight line between the two roller (24). Thereby, the tool handle (50) is constrained within the U-shaped recess (13). In the U-shaped recess (13), the tool handle (50) is hold by the uneven squeezing face with multiple ridges and grooves (212, 214) surrounding around and clamped by the deformed roller sleeves (22) to keep from dropping. Therefore, a user only has to enforce the tool handle (50) to enter the stick recess (13) in which the tool handle (50) is firmly secured.

Figure 5:
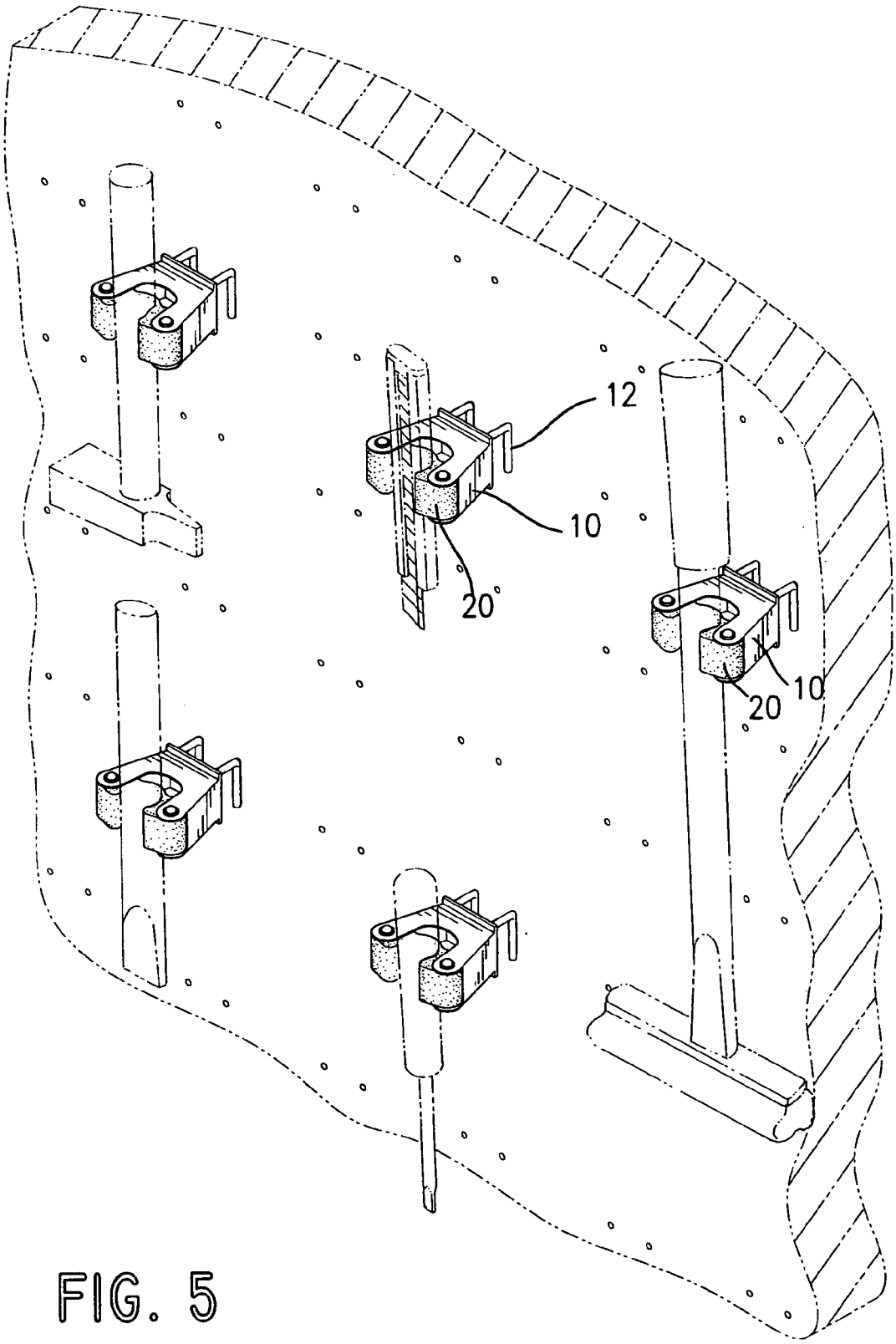
FIG. 5 is an operational perspective view of multiple suspension devices in FIG. 1 attached to a surface by hooks.

With reference to FIG. 5, the suspension device with the two hooks (12) is attached to a wall or panel by inserting the two hooks (12) into a pair of holes (not numbered) defined through the wall or panel.

Figure 6:
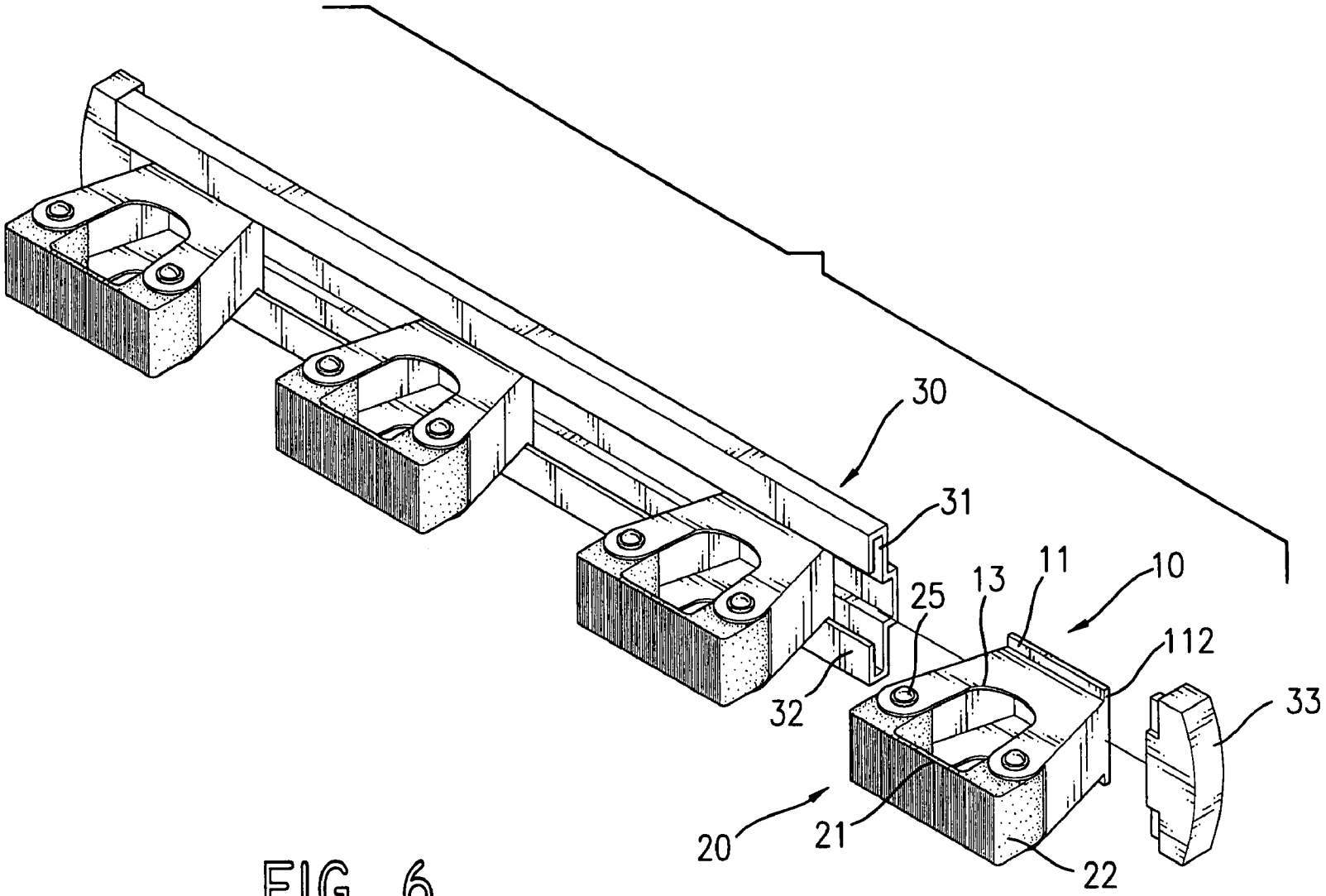
FIG. 6 is an operational perspective view of another embodiment of multiple suspension devices in accordance with the present invention, wherein the suspension devices slidably mounted in a track.

With reference to FIG. 6, another operational embodiment of the suspension device in accordance with the present invention does not have hooks and is slidably mounted on a track assembly (30). The track assembly (30) comprises a track (31) and two optional end plugs (33). The track (31) has two short ends (not numbered), two long hooked ends (not numbered) and an access (not numbered) defined in each of the two short ends. The two long hooked ends define two opposite slits within the track (31) to hold slidably the top and bottom lips (112) on the back plate (11). Thereby, the body (10) is movably mounted on the track (30), the position of the tool handle can be adjusted anywhere along the track (31). The two end plugs (33) are detachably mounted respectively in the two short ends to close the accesses at the short ends.

The suspension device for a tool handle as described has the following advantages:

1. The tool handle is simply pressed into the U-shaped recess (13) to clamp a tool to the suspension device. The operation of the suspension device is easy and convenient.

2. In cooperation with the track assembly, the suspension device slides on the track to adjust the position of the tool handle in a convenient way.

Although the invention has been explained in relation to its preferred embodiment, many other possible modifications and variations can be made without departing from the spirit and scope of the invention as hereinafter claimed.

What is claimed is:

1. A suspension device for a tool handle, the suspension device comprising:

a hollow body (10) having a back plate (11) with a top edge, a bottom edge, two side ends, a front surface and a rear surface;

two braces extending respectively from the two side ends of the back plate (11), each of the two braces has a top edge and a bottom edge;

a top bracket extending from the front surface of the back plate (11) near the top edge and having a front end, two side edges connected respectively to the top edges of the two braces, a U-shaped recess (13) formed in the front end, two ears (14) formed respectively on opposite sides of the U-shaped recess (13) at the front end, and two pivot pin holes (15) formed respectively in the ears (14) near the front end;

a bottom bracket extending from the front surface of the back plate near the bottom edge to correspond to the top bracket and having a front end, two side edges connected respectively to the bottom edges of the two braces, a U-shaped recess formed in the front end, two ears formed respectively on opposite sides of the U-shaped recess at the front end, and two pivot pin holes formed respectively in the ears near the front end; and two roller spaces (16) defined between opposite two of the ears (14) on the top and bottom bracket;

an elastic bracket (20) made of resilient material and having a straight sheet (21) with two ends and two roller sleeves (22) formed respectively at the two ends of the straight sheet (21), wherein the straight sheet (21) has an outer face and each roller sleeve (22) is mounted in the roller space (16) and has a roller cavity (23) defined in the roller sleeve (22);

two rollers (24) mounted respectively inside the two roller cavities (23) and having axial through holes (242); and two pins (25) respectively passing through the pivot pin holes (15) respectively in the opposite two of the ears (14) on the top and bottom brackets and the axial through holes (242) in the rollers (24) to pivotally attach the elastic bracket (20) to the hollow body (10).

2. The suspension device for a tool handle as claimed in claim 1, wherein the hollow body (10) further has two hooks (12) attached to and extending out from the rear face of the back plate (11).

3. The suspension device for a tool handle as claimed in claim 1, wherein the suspension device further comprises a track assembly having a track (31) with two short ends, two long hooked ends and two accesses respectively defined in the two short ends; and two end plugs (33) detachably mounted respectively at the two short ends to close the accesses;

wherein the back plate (11) further has a top lip (112) formed along the top edge and a bottom lip formed along the bottom edge to respectively engage the hooked ends on the track (31) through the accesses.

4. The suspension device for a tool handle as claimed in claim 1, wherein the elastic bracket (20) is made of rubber.

5. The suspension device for a tool handle as claimed in claim 1, wherein the elastic bracket (20) is made of pliable synthetic material.

6. The suspension device for a tool handle as claimed in claim 1, wherein the outer face on the elastic bracket (20) has multiple ridges (212) defined transversely on the entire outer face.

7. The suspension device for a tool handle as claimed in claim 6, wherein the outer face of the elastic bracket (20) has multiple widened V-shaped grooves (214) defined transversely at intervals on the outer face.

8. The suspension device for a tool handle as claimed in claim 7, wherein each roller cavity (23) has an inner surface and multiple teeth (222) formed longitudinally on the inner surface; and each roller (24) has an outer surface and multiple teeth (244) defined longitudinally on the outer surface to match with the multiple teeth (222) in the roller cavity (23) of a corresponding one of the roller sleeves (22).

* * * * *